United States Patent [19]

Wenzel et al.

[11] Patent Number: 5,052,501

[45] Date of Patent: Oct. 1, 1991

[54] ADJUSTABLE BENT HOUSING

[76] Inventors: Douglas Wenzel; Robert Wenzel; William Wenzel, all of 7220 - 68 Avenue, Edmonton, Alberta, Canada, T6B 0A1

[21] Appl. No.: 566,150

[22] Filed: Aug. 10, 1990

[51] Int. Cl.[5] ..... E21B 7/08

[52] U.S. Cl. ..... 175/74; 175/61; 285/184

[58] Field of Search ..... 175/61, 74, 73, 75; 285/93, 184, 282

[56] References Cited

U.S. PATENT DOCUMENTS

| | | | |
|---|---|---|---|
| 1,850,403 | 3/1932 | Lee . | |
| 3,586,116 | 6/1971 | Tiraspolsky | 175/74 |
| 3,717,208 | 2/1973 | Anderson | 175/74 |
| 4,077,657 | 3/1978 | Trzeciak | 285/184 |
| 4,220,214 | 9/1980 | Benoit | 175/61 |
| 4,258,800 | 3/1981 | Hipp | 175/61 |
| 4,596,294 | 6/1986 | Russell | 175/74 |
| 4,811,798 | 3/1989 | Falgout, Sr. et al. | 175/73 |
| 4,813,497 | 3/1989 | Wenzel | 175/74 |
| 4,843,945 | 7/1989 | Dinsdale | 81/57.34 |
| 4,913,466 | 4/1990 | Becker | 285/24 |

*Primary Examiner*—William P. Neuder
*Attorney, Agent, or Firm*—Davis, Bujold & Streck

[57] ABSTRACT

An adjustable bent housing consisting of an inner housing telescopically received within an outer housing. A sleeve is provided having an angularly offset clutch face. Spline non-rotatably couple an interior surface of the sleeve with an exterior surface of the inner housing. The sleeve is axially slidable along the exterior surface of the inner housing between an inoperative position wherein the sleeve is spaced from the outer housing and an operating position. In the operative position the angularly offset clutch face of the sleeve engages an angularly offset clutch face on the outer housing thereby non-rotatably coupling the inner housing and the outer housing in a bent position the magnitude of which is dependent upon the relative rotational positioning of the outer housing and the inner housing. A first annular member, having a concave radiused contact surface, projects from the exterior surface at the first end of the inner housing, A second annular member having a convex contact surface projects from the interior surface at the second end of the outer housing. The convex contact surface of the second annular member engaging the concave contact surface of the first annular member thereby preventing axial separation of the inner housing and the outer housing while accommodating the bend created when the sleeve is secured in the operative position. A locking nut is threadedly engageable with the exterior surface of the inner housing to secure the sleeve in the operative position.

2 Claims, 1 Drawing Sheet

ADJUSTABLE BENT HOUSING

The present invention relates to an adjustable bent housing.

BACKGROUND OF THE INVENTION

Downhole motors are used within the oil industry for "directional" drilling. In "Directional" drilling the borehole deviates at an angle to the vertical. The angle is created by placing a bent sub in the drill string, which causes the borehole to deviate as drilling progresses. Boreholes are presently being drilled which approach a horizontal deviation. The intent of such substantially horizontal deviations is to cut across an oil bearing formation, thereby increasing production. The downhole motors used in directional drilling generally produce an eccentric motion in response to the flow of drilling fluids or "mud" pumped down the drill string from surface pumps. This eccentric motion is converted to concentric motion by a drive shaft having universal joint type connections which is secured to a bearing assembly which rotates the drill bit. It has become recognized in the art that the bend in the drill string should be placed as close as possible to the drill bit. For this reason, the practise has developed of placing a bend in a housing through which the drive shaft connecting the bearing assembly and downhole motor extends. In order to avoid the necessity of disassembling the components which make up the downhole motor assembly whenever it is necessary to alter the "bend", adjustable bent housings were developed.

SUMMARY OF THE INVENTION

The present invention concerns a new form of adjustable bent housing.

According to the present invention there is provided an adjustable bent housing which is comprised of a tubular outer housing having a first end, a second end, and an interior surface. The second end of the outer housing has an angularly offset clutch face. A tubular inner housing is provided having a first end, a second end and an exterior surface. The first end of the inner housing is telescopically received within the second end of the outer housing. A sleeve is provided having a first end, a second end, and an interior surface. The first end of the sleeve has an angularly offset clutch face. Surface engagement means non-rotatably couple the interior surface of the sleeve with the exterior surface of the inner housing. The sleeve is axially slidable along the exterior surface of the inner housing between an inoperative position wherein the first end of the sleeve is spaced from the second end of the outer housing and an operative position. In the operative position the angularly offset clutch face at the first end of the sleeve engages the angularly offset clutch face at the second end of the outer housing thereby non-rotatably coupling the inner housing and the outer housing in a bent position the magnitude of which is dependent upon the relative rotational positioning of the outer housing and the inner housing. A first annular member, having a concave radiused contact surface, projects from the exterior surface at the first end of the inner housing. A second annular member having a convex contact surface projects from the interior surface at the second end of the outer housing. The convex contact surface of the second annular member engages the concave contact surface of the first annular member thereby preventing axial separation of the inner housing and the outer housing while accommodating the bend created when the sleeve is secured in the operative position. A locking nut is threadedly engageable with the exterior surface of the inner housing to secure the sleeve in the operative position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
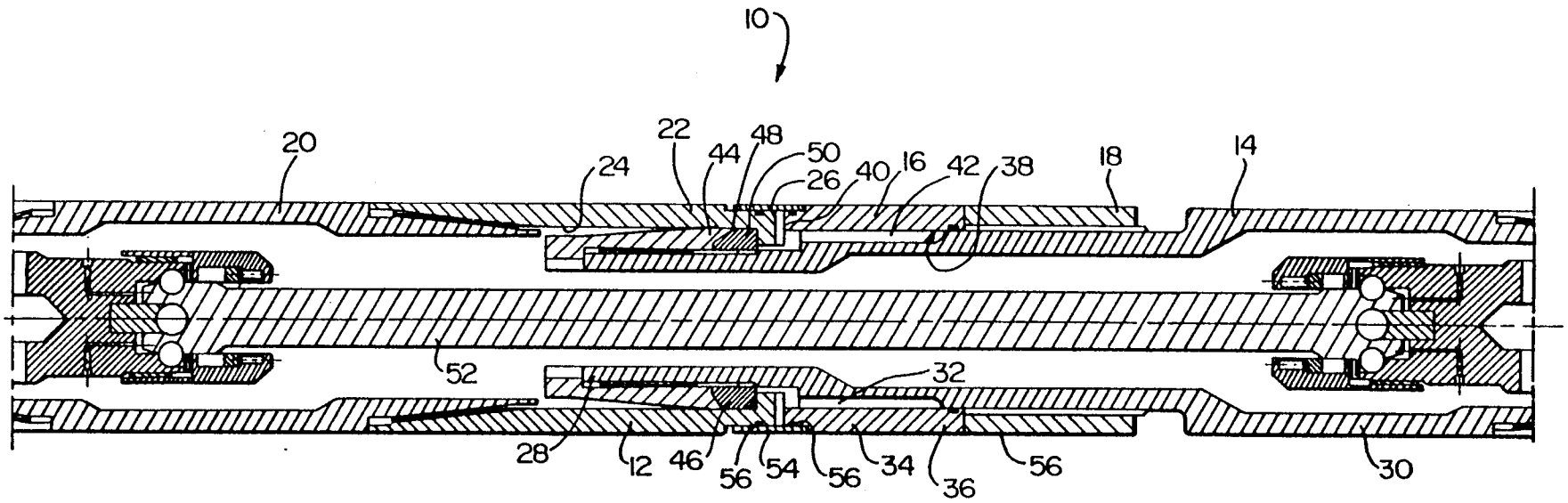
FIG. 1 is a longitudinal section view of a preferred embodiment of an adjustable bent housing constructed in accordance with the teachings of the invention.

The preferred embodiment, an adjustable bent housing generally identified by reference numeral 10, will now be described with reference to FIG. 1. The primary components of adjustable bent housing 10 are a tubular outer housing 12, a tubular inner housing 14, a sleeve 16 and a locking nut 18.

Outer housing 12 has a first end 20, a second end 22, and an interior surface 24. Second end 22 of outer housing 12 has an angularly offset clutch face 26. Inner housing 14 has a first end 28, a second end 30 and an exterior surface 32. First end 28 is telescopically received within second end 22 of outer housing 12. Sleeve 16 has a first end 34, a second end 36, and an interior surface 38. First end 34 of sleeve 16 has an angularly offset clutch face 40. Locking nut 18 is threadedly engageable with exterior surface 32 of inner housing 14. Surface engagement means in the form of mating spline 42 non-rotatably couple interior surface 38 of sleeve 16 with exterior surface 32 of inner housing 14. Stop means are provided in the form of a first annular member 44 and a second annular member 46. First annular member 44 projects from exterior surface 32 at first end 28 of inner housing 14 and threadably engaged therewith. It is important to note that first annular member 44 has a concave radiused contact surface 48. Second annular member 46 projects from interior surface 24 at second end 22 of outer housing 12. Second annular member 46 has a convex radiused contact surface 50.

Adjustable bent housing 10 has some features directed solely to preventing drilling fluids from entering under sleeve 16 or between clutch faces 26 or 40. Sealing sleeve 54 covers clutch face 26 and 40 when they are in an operative or engaged position. A number of O ring seals 56 are positioned to seal against the entry of drilling fluids under sealing sleeve 54 or sleeve 16.

The use and operation of adjustable bent housing 10 will now be described with reference to FIG. 1. In FIG. 1 adjustable bent housing is shown with a drive shaft 52 having universal joint connections extending therethrough. Drive shaft 52 is not part of the invention and merely depicts the environment in which adjustable bent housing 10 must function. Adjustment of adjustable bent housing 10 is accomplished by means of movement of sleeve 16. Although sleeve 16 is non-rotatably coupled to inner housing 14 by mating spline 42, sleeve 16 is axially slidable along exterior surface 32 of inner housing 14 between an operative position and an inoperative position. In the inoperative position (not shown), first end 34 of sleeve 16 is spaced from second end 22 of outer housing 12. In this position, relative rotation of outer housing 12 and inner housing 14 is possible. In the operative position angularly offset clutch face 40 at first end 34 of sleeve 16 engages angularly offset clutch face 26 at second end 22 of outer housing 12, thereby non-rotatably coupling inner housing 14 and outer housing 12 in a bent position the magnitude of which is dependent upon the relative rotational positioning of outer housing 12 and inner housing 14. Contact surface 50 of second annular member 46 engages contact surface 48 of first annular member 44 to prevent axial separation of inner housing 14 and outer housing 12. It is important to note that the stop means employed to prevent the axial separation of inner housing 14 and outer housing 12 must be capable of adjusting to differences in the positioning of inner housing 14 and outer housing 12 in alternative "bent" positions. Radiused contact surfaces 48 and 50 play a vital role in this regard. Convex radiused contact surface 46 of second annular member 46 is received by concave radiused contact surface 48 of first annular member 44. The engagement between concave contact surface 48 and convex contact surface 50 accommodates the bend created when sleeve 16 is secured in the operative position. Locking nut 18 secures sleeve 16 in the preselected operative position.

Although not illustrated in FIG. 1, indicia are placed on the external surface of both outer housing 12 and inner housing 14 for assistance in adjusting adjustable bent housing 10 to the desired angular deviation. When manufacturing adjustable bent housing 10, it is preferable that contact surfaces 48 and 50 be radiused from a notional centerpoint where angularly offset clutch face 40 at first end 34 of sleeve 16 engages angularly offset clutch face 26 at second end 22 of outer housing 12.

It will be apparent to one skilled in the art that modifications may be made to the preferred embodiment of the invention without departing from the spirit and scope of the invention.

The embodiments of the invention in which an exclusive property or privilege is claimed are defined as follows:

1. An adjustable bent housing, comprising:

a. a tubular outer housing having a first end, a second end, and an interior surface, the second end of the outer housing having an angularly offset clutch face;

b. a tubular inner housing having a first end, a second end and an exterior surface, the first end being telescopically received within the second end of the outer housing;

c. a sleeve having a first end, a second end, and an interior surface, the first end of the sleeve having an angularly offset clutch face;

d. surface engagement means for non-rotatably coupling the interior surface of the sleeve with the exterior surface of the inner housing, the sleeve being axially slidable along the exterior surface of the inner housing between an inoperative position wherein the first end of the sleeve is spaced from the second end of the outer housing and an operative position wherein the angularly offset clutch face at the first end of the sleeve engages the angularly offset clutch face at the second end of the outer housing thereby non-rotatably coupling the inner housing and the outer housing in a bent position the magnitude of which is dependent upon the relative rotational positioning of the outer housing and the inner housing;

e. a first annular member projecting from the exterior surface at the first end of the inner housing, the first annular member having a concave radiused contact surface;

f. a second annular member projecting from the interior surface at the second end of the outer housing, the second annular member having a convex radiused contact surface, the convex contact surface of the second annular member engaging the concave contact surface of the first annular member thereby preventing axial separation of the inner housing and the outer housing while accommodating the bend created when the sleeve is secured in the operative position; and g. a locking nut threadedly engageable with the exterior surface of the inner housing, the locking nut being adapted to secure the sleeve in the operative position.

2. The adjustable bent housing as defined in claim 1, the surface engagement means being mating spline.

* * * * *